US005523149A

United States Patent [19]

Kijimuta et al.

[11] Patent Number: 5,523,149

[45] Date of Patent: Jun. 4, 1996

[54] ALUMINA SOL COATED RECORDING SHEET

[75] Inventors: Hitoshi Kijimuta; Masaaki Saito; Yasumasa Yukawa, all of Yokohama, Japan

[73] Assignee: Asahi Glass Company Ltd., Tokyo, Japan

[21] Appl. No.: 274,710

[22] Filed: Jul. 14, 1994

[30] Foreign Application Priority Data

Jul. 14, 1993 [JP] Japan ..... 5-197011

[51] Int. Cl.[6] ..... B41M 5/00

[52] U.S. Cl. ..... 428/307.3; 428/195; 428/304.4; 428/520; 428/704

[58] Field of Search ..... 428/195, 331, 428/520, 704, 304.4, 307.3

[56] References Cited

U.S. PATENT DOCUMENTS

| | | | |
|---|---|---|---|
| 5,104,730 | 4/1992 | Misuda et al. . | |
| 5,141,797 | 8/1992 | Wheeler | 428/195 |
| 5,275,867 | 1/1994 | Misuda et al. . | |

FOREIGN PATENT DOCUMENTS

| | | |
|---|---|---|
| 0407720 | 1/1991 | European Pat. Off. . |
| 0493100 | 7/1992 | European Pat. Off. . |

*Primary Examiner*—Pamela R. Schwartz
*Attorney, Agent, or Firm*—Oblon, Spivak, McClelland, Maier & Neustadt

[57] ABSTRACT

An alumina sol coating fluid containing an alumina hydrate and a polyvinyl alcohol and having boric acid or a borate incorporated therein.

4 Claims, No Drawings

ALUMINA SOL COATED RECORDING SHEET

The present invention relates to an alumina sol coating fluid, particularly an alumina sol coating fluid for forming an ink-receiving layer of a recording sheet.

In recent years, there have been many opportunities in which overhead projectors are employed instead of conventional slide projectors, for presentation at meetings of various academic societies or at various other meetings. Further, in the field of printing, transparent printed matters are required for various publications, packaging etc.

In writing or printing on such transparent sheets, special caution or care is required particularly for the printing speed or drying, as compared with printing on usual paper sheets, since the transparent sheets lack in ink absorptivity. Also with opaque substrates, ink absorptivity is poor, and similar caution or care is required in many cases.

On the other hand, it is reported, for example, in U.S. Pat. No. 5,104,730 that a recording sheet having an adsorbent layer of an alumina hydrate formed on a transparent non-absorptive substrate, is capable of solving above problems and thus suitable for use as a recording medium. This recording sheet comprises a transparent substrate such as a polyethylene terephthalate and a layer of a porous alumina hydrate, formed thereon, which absorbs and fixes mainly a colorant in ink. This porous alumina hydrate layer is formed by coating on the substrate a coating fluid comprising an alumina sol of boehmite crystal particles and a binder of polyvinyl alcohol type, followed by drying.

However, the coating fluid comprising an alumina sol and a polyvinyl alcohol type binder is likely to undergo an increase of the viscosity. This problem can be reduced by selecting the binder with proper characteristics. However, when it has been attempted to obtain a coating layer having a particularly good absorptivity, it has been likely that fine cracks result during the drying operation.

It is an object of the present invention to prevent formation of fine cracks during the drying operation in the process for producing an alumina coating layer having good absorptivity.

Thus, the present invention provides an alumina sol coating fluid containing an alumina hydrate and a polyvinyl alcohol and having boric acid or a borate incorporated therein.

Now, the present invention will be described in detail with reference to the preferred embodiments.

In the present invention, the alumina hydrate may be any alumina hydrate so long as it is capable of forming a porous layer which is effectively absorbing e.g. the solvent in an ink, when it is coated on a substrate surface. However, boehmite ($Al_2O_3.nH_2O$, n=1 to 1.5) is particularly preferred.

The alumina hydrate layer obtained by coating the alumina sol coating fluid of the present invention on a substrate, preferably has a porous structure consisting essentially of pores with a diameter of from 1 to 15 nm and having a pore volume of from 0.3 to 1.0 cc/g, whereby the alumina hydrate layer has adequate absorptivity and the layer itself has transparency. Here, if the substrate is a transparent sheet, the resulting coated sheet will be transparent. Even if the substrate is opaque, such transparent alumina hydrate layer does not impair the texture of the substrate and higher-quality image can be formed on it.

It is preferred particularly from the viewpoint of both the fixing ability of colorant and transparency that in addition to above physical properties, the average pore radius of the alumina hydrate layer is from 1.5 to 8 nm, and the volume of pores with a radius within a range of ±1 nm of the average pore radius is at least 45% of the total pore volume. More preferably, the average pore radius is from 4.5 to 7 nm, and the volume of pores with a radius within a range of ±1 nm of the average pore radius is at least 55%. In the present invention, the pore size distribution is measured by a nitrogen adsorption and desorption method.

In the present invention, the content of the alumina hydrate in the coating fluid is preferably from 10 to 30 wt %. The solvent is preferably water.

The coating fluid of the present invention contains a polyvinyl alcohol as the binder. The amount of the polyvinyl alcohol is preferably such that the polyvinyl alcohol is from 5 to 50 wt % of the alumina hydrate. If the amount of the binder is less than the above range, the mechanical strength of the alumina hydrate layer tends to be inadequate. On the other hand, if it exceeds the above range, ink-absorptivity of the alumina hydrate layer tends to be impaired.

The polyvinyl alcohol used as the binder preferably has a saponification degree of at least 90% and a polymerization degree of at least 500.

The coating fluid of the present invention contains boric acid or a borate in an amount of from 0.1 to 10 wt % as calculated as $H_3BO_3$ relative to the polyvinyl alcohol as the binder. If the content as calculated as $H_3BO_3$ is less than 0.1 wt %, no adequate effect of the present invention tends to be obtained, and it tends to be difficult to prevent formation of fine cracks during the drying operation or to increase the absorptivity. On the other hand, if the content as calculated as $H_3BO_3$ exceeds 10 wt %, the change with time of the viscosity of the coating fluid tends to substantial, and the coating stability tends to poor. A preferred content of the boric acid or the borate is from 1 to 5 wt % as calculated as $H_3BO_3$.

As the boric acid, not only orthoboric acid but also metaboric acid and hypoboric acid may be used. As the borate, soluble salts of these boric acids are preferably employed. Specifically, $Na_2B_4O_7.10H_2O$, $NaBO_2.4H_2O$, $K_2B_4O_7.5H_2O$, $KBO_2$, $NH_4B_4O_9.3H_2O$ and $NH_4BO_2$ may, for example, be mentioned.

The coating fluid may be coated on various substrates by means of e.g. a die coater, a roll coater, an air knife coater, a blade coater, a rod coater, a bar coater or a comma coater. The thickness of the coated layer may optionally be selected depending upon the specification of e.g. the particular printer, the type of the ink to be used for recording or its solvent, the amount of the ink, etc.

By coating the alumina sol coating fluid of the present invention on a substrate, followed by drying, it is possible to obtain a recording sheet which comprises a substrate and an alumina hydrate layer formed thereon, wherein the alumina hydrate layer contains a polyvinyl alcohol in an amount of from 5 to 50 wt % relative to the alumina hydrate and boric acid or a borate in an amount of from 0.1 to 10 wt % as calculated as $H_3BO_3$ relative to the polyvinyl alcohol.

This recording sheet has excellent absorptivity and an excellent fixing ability of the colorant. It can preferably be used particularly as a recording medium for an ink jet printer.

The mechanism for suppressing formation of fine cracks by an addition of boric acid or a borate in the coating fluid of the present invention, is not clearly understood. However, it is considered that the boric acid or the borate acts on the polyvinyl alcohol as the binder to promote the geling rate thereof, whereby the strength and uniformity of the coated layer will be improved. Further, as a result, migration of the polyvinyl alcohol during the drying step will be suppressed, and absorptivity will be improved.

Now, the present invention will be described in further detail with reference to Examples. However, it should be understood that the present invention is by no means restricted by such specific Examples.

EXAMPLE 1

2 g of an aqueous solution containing 5 wt % of $H_3BO_3$ was added to 100 g of an alumina sol having a solid content of 18.35 wt %, prepared by hydrolysis-peptization of an aluminum alkoxide, and the mixture was heated to 40° C. Then, 20.2 g of an aqueous solution containing a polyvinyl alcohol (saponification degree: 97%, polymerization degree: 2300) was mixed thereto to obtain a coating fluid having a solid content of 16 wt %.

This coating fluid was coated on a transparent polyethylene terephthalate film (thickness: 125 μm) by a bar coater so that the coated amount after drying would be 23 g/m$^2$, and then dried in an oven at 65° C. followed by heat treatment at 140° C. The coated film thereby obtained was free from fine cracks, and its haze value was 4.2. Further, it had adequate absorptivity for recording by an ink jet printer.

EXAMPLE 2

A recording sheet was prepared in the same manner as in Example 1 except that the amount of the aqueous solution containing 5 wt % of $H_3BO_3$ was changed to 1 g. No formation of fine cracks was observed, and the haze value was 5.0. Further, it had the same absorptivity as the recording sheet of Example 1.

COMPARATIVE EXAMPLE

Using the same alumina sol and polyvinyl alcohol solution as used in Example 1, a coating fluid having no $H_3BO_3$ incorporated, was prepared, and a coated film was prepared in the same manner as Example 1. The obtained coated film had numerous fine cracks (lengths of about 1 mm) in an area of an A4 size, and the haze value was 5.6.

With the alumina sol coating fluid of the present invention, it is possible to prevent formation of fine cracks during the drying step and to obtain an alumina layer having excellent absorptivity and free from drawbacks. The coated layer obtained by coating and drying this coating fluid, has a low haze and is excellent in transparency, and thus it has an effect of suppressing the haze. It is excellent also in absorptivity.

We claim:

1. A recording sheet comprising a substrate and a alumina hydrate layer formed thereon, wherein the alumina hydrate layer contains a polyvinyl alcohol in an amount of from 5 to 50 wt % relative to the alumina hydrate, and boric acid or a borate in an amount of from 0.1 to 10 wt % as calculated as $H_3BO_3$ relative to the polyvinyl alcohol.

2. The recording sheet according to claim 1, wherein the alumina hydrate is boehmite.

3. The recording sheet according to claim 1, wherein the alumina hydrate layer has a porous structure consisting essentially of pores with a radius of 1 to 15 nm and having a pore volume of from 0.3 to 1.0 cc/g.

4. The recording sheet according to claim 1, wherein the average pore diameter of the alumina hydrate layer is from 1.5 to 8 nm, and the volume of pores with a radius within a range of ±1 nm of the average pore radius is at least 45% of the total pore volume.

* * * * *